US008579687B2

(12) United States Patent
Neveaux

(10) Patent No.: US 8,579,687 B2
(45) Date of Patent: Nov. 12, 2013

(54) ELECTRONIC BOARD GAME USING REACTION TIME

(76) Inventor: David Neveaux, West Seneca, NY (US)

( * ) Notice: Subject to any disclaimer, the term of this patent is extended or adjusted under 35 U.S.C. 154(b) by 25 days.

(21) Appl. No.: 13/320,936

(22) PCT Filed: May 18, 2010

(86) PCT No.: PCT/US2010/035185

§ 371 (c)(1),
(2), (4) Date: Nov. 17, 2011

(87) PCT Pub. No.: WO2010/135275

PCT Pub. Date: Nov. 25, 2010

(65) Prior Publication Data

US 2012/0058809 A1 Mar. 8, 2012

Related U.S. Application Data

(60) Provisional application No. 61/179,226, filed on May 18, 2009.

(51) Int. Cl.
*A63F 9/24* (2006.01)

(52) U.S. Cl.
USPC ..... 463/10; 463/7; 463/11; 273/148 A

(58) Field of Classification Search
USPC ..... 273/148 A; 463/10, 11, 47, 7
See application file for complete search history.

(56) References Cited

U.S. PATENT DOCUMENTS 4,166,452 A 9/1979 Generales, Jr.
4,187,671 A 2/1980 Fatton
4,257,600 A 3/1981 Goldfarb
4,261,563 A * 4/1981 Goldfarb ..... 463/7
4,309,030 A * 1/1982 Goldfarb et al. ..... 463/7
4,322,073 A 3/1982 Slavik et al.
4,463,946 A 8/1984 Wallace et al.
4,534,557 A 8/1985 Bigelow et al.
4,755,140 A 7/1988 Rimland
4,763,284 A 8/1988 Carlin
4,789,155 A 12/1988 Barra
4,895,364 A * 1/1990 Martel et al. ..... 273/237
4,913,432 A 4/1990 Barra
5,060,941 A 10/1991 Barra
5,092,779 A * 3/1992 Piwonka et al. ..... 434/352
5,271,627 A 12/1993 Russell et al.
5,605,336 A 2/1997 Gaoiran et al.
5,882,011 A * 3/1999 Praria ..... 273/445

(Continued)

OTHER PUBLICATIONS

Wikipedia, "Spoons", online encyclopedia description and definition of Spoons, printed from worldwide web on May 3, 2010 and found at http://en.wikipedia.org/wiki/Spoons, 6 pages.

*Primary Examiner* — Lawrence Galka
(74) *Attorney, Agent, or Firm* — Hiscock & Barclay, LLP

(57) ABSTRACT

Disclosed in this specification is an electronic board game. In use, a primary game (e.g. a card game) is played until one of the players presses an activation button. The other players attempt to quickly react and press their buttons. The faster they react, the more points the players earn. The initial activation of the timers can be done when that player perceives a predetermined event that occurred during the card game. The player may attempt to bluff the other players by pressing the button without having perceived the event but doing so risks the other players issuing a challenge. In certain embodiments, the cards are selected to help players learn basic skills, such as shapes, colors, or mathematical operations.

12 Claims, 7 Drawing Sheets

(56) References Cited

U.S. PATENT DOCUMENTS

| | | | | |
|---|---|---|---|---|
| 5,901,961 | A | 5/1999 | Holland, III | |
| 5,947,478 | A | 9/1999 | Kwan et al. | |
| 6,776,732 | B2 | 8/2004 | Parkinson et al. | |
| 7,628,404 | B2 | 12/2009 | Elvidge | |
| 7,695,357 | B2 * | 4/2010 | Fleury et al. | 463/11 |
| 8,088,003 | B1 * | 1/2012 | Bickerton et al. | 463/30 |
| 2003/0176221 | A1 * | 9/2003 | Chung | 463/42 |
| 2007/0117073 | A1 * | 5/2007 | Walker et al. | 434/236 |
| 2008/0284102 | A1 * | 11/2008 | Mizrahi | 273/299 |
| 2009/0096159 | A1 * | 4/2009 | Kenney et al. | 273/148 A |

* cited by examiner

ELECTRONIC BOARD GAME USING REACTION TIME

CROSS-REFERENCE TO RELATED APPLICATIONS

This application claims priority to and the benefit of U.S. provisional patent application Ser. No. 61/179,226, filed May 18, 2009, which application is incorporated herein by reference in its entirety.

FIELD OF THE INVENTION

This invention relates, in one embodiment, to an electronic board game that awards points based on the reaction time of players. In certain embodiments, points are earned either through the strategic use of buffs and challenges to bluffs or by fast reaction time.

BACKGROUND

Fast paced board games are enjoyed by many people. U.S. Pat. No. 7,628,404to Elvidge describes a reaction-time game that generates a signal at a random interval. The players rush to activate their input device with the slowest player receiving a mild electrical shock. Unfortunately, the start signal is random and the game quickly becomes repetitious. U.S. Pat. No. 4,261,563to Goldfarb describes a reaction-time game that prompts one player to quickly react to the moves of a competing player. The game is limited to two players and game is generally too simple to excite many players. Therefore, an improved game is desired that promotes social interaction, requires quick reaction times and provides a deeper level of strategic play than prior art reaction-time games.

SUMMARY OF THE INVENTION

The invention comprises, in one form thereof, an electronic board game. In use, a game (e.g. a card game) is played until one of the players presses an activation button. The other players attempt to quickly react and press their buttons. The faster they react, the more points the players earn. The initial activation of the timers can be done when that player perceives a predetermined event that occurred during the card game. The player may attempt to bluff the other players by pressing the button without having perceived the event but doing so risks the other players issuing a challenge.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION OF A PREFERRED EMBODIMENT

Figure 1:
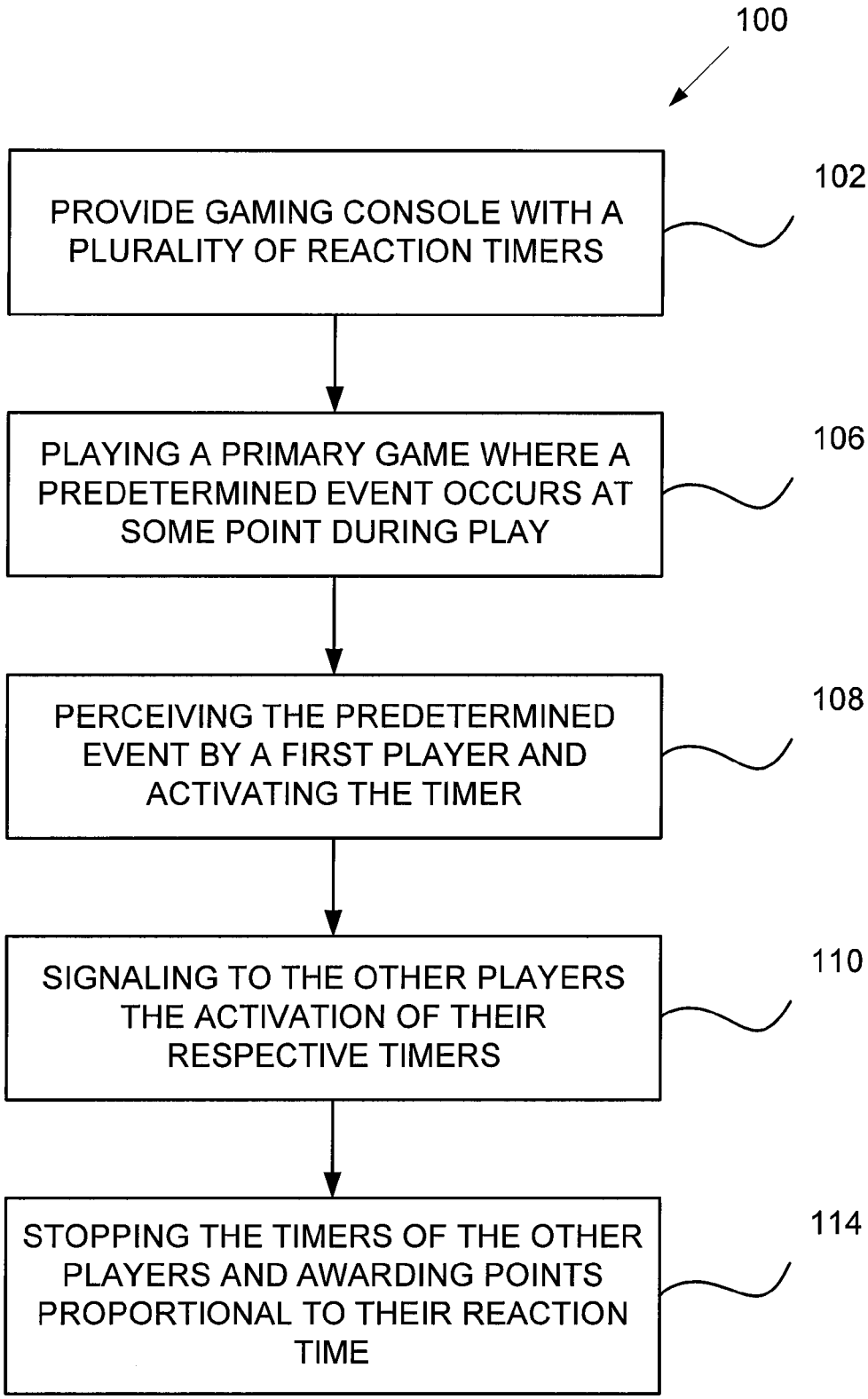
FIG. 1 is a flow diagram of one process of the invention.

Referring to FIG. 1, process 100 is depicted for playing an electronic board game. In step 102 of process 100, a gaming console is provided that includes a plurality of reaction timers. See FIG. 2, FIG. 3A and FIG. 3B for a depiction of one such gaming console.

Figure 2:
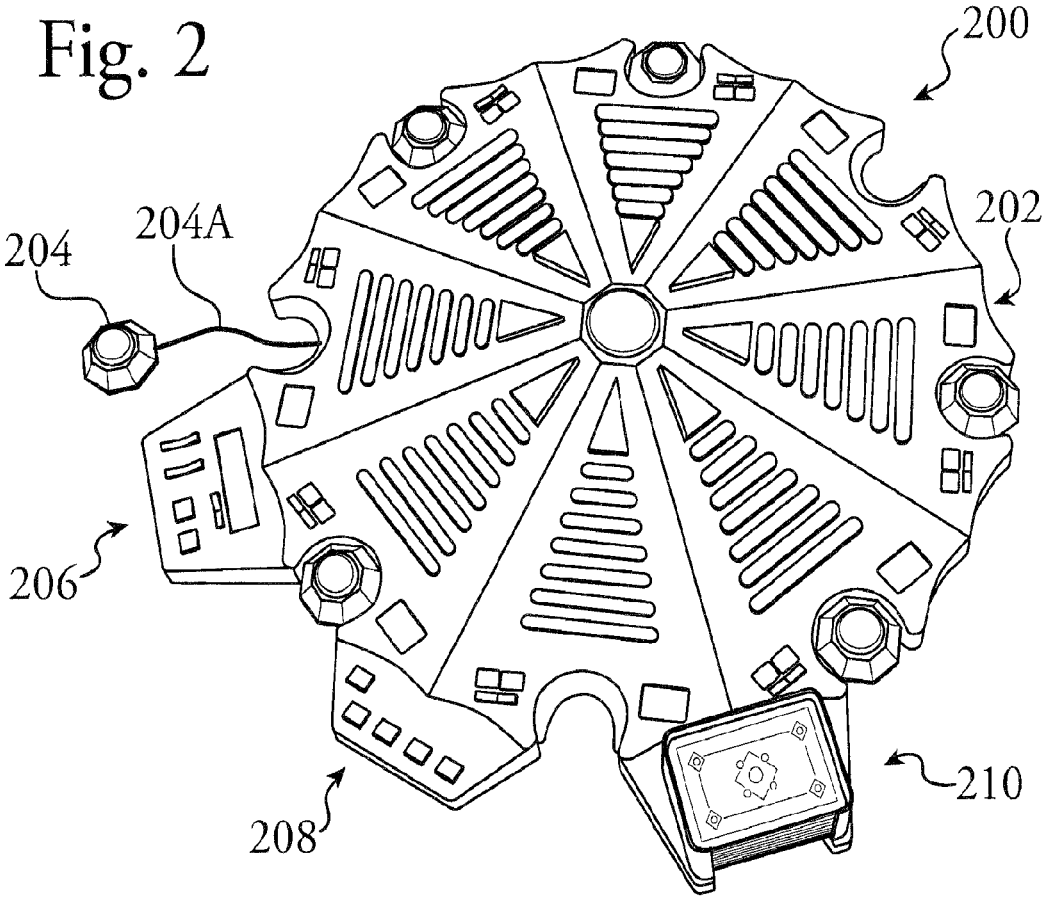
FIG. 2 is a depiction of one console for use with the present invention.
Figure 3A:
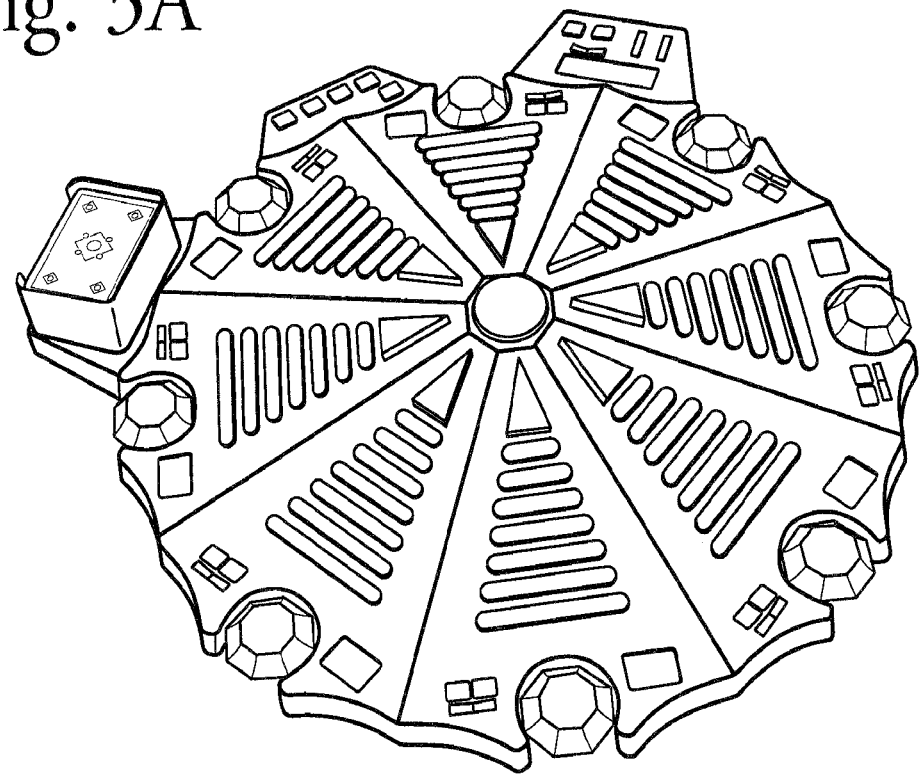
FIG. 3A is a perspective view of a console for use with the invention.
Figure 3B:
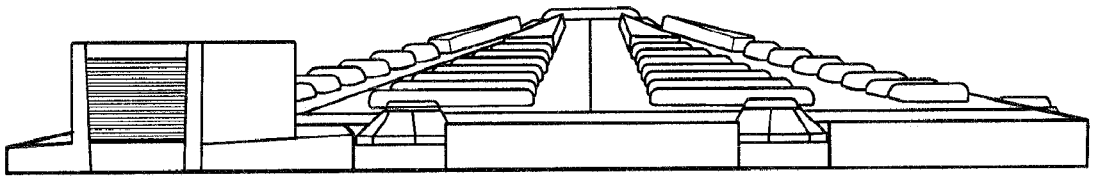
FIG. 3B is a side view of the console of FIG. 3A.

Referring to FIG. 2, electronic gaming console 200 includes a plurality of stations 202. In one embodiment, a console has only a single station. In another embodiment, there are two stations. In another embodiment, there are between two and eight stations. Other station numbers are also contemplated for use with the present invention. Although the stations are monolithically joined to the console in FIG. 2, in other embodiments, the stations are separated from one another but are in communication with one another through wired connections or wireless connections. Regardless of the number of stations and their mode of connection, each station includes an activation button 204. Therefore, this is one button per player. In the embodiment of FIG. 2, the activation button is detachable from the console 200. In FIG. 2, two of the stations have had their activation buttons removed to show the docking area of the activation buttons 204. In FIG. 3A, all buttons are shown. Wire 204*a* permits the activation button to be in communication with the console 200. Each console includes a timer (not shown). When the activation button of any one station is pressed by a first player, the timers associated with the other activation stations start. The timer associated with the first player's station is not activated. A signal is given to the other players that their timers have started. Each player with an active timer attempts to quickly activate their activation button which stops the timer. Points are awarded to those players who react quickly, thus minimizing the amount of time measured by their timer.

Figure 4:
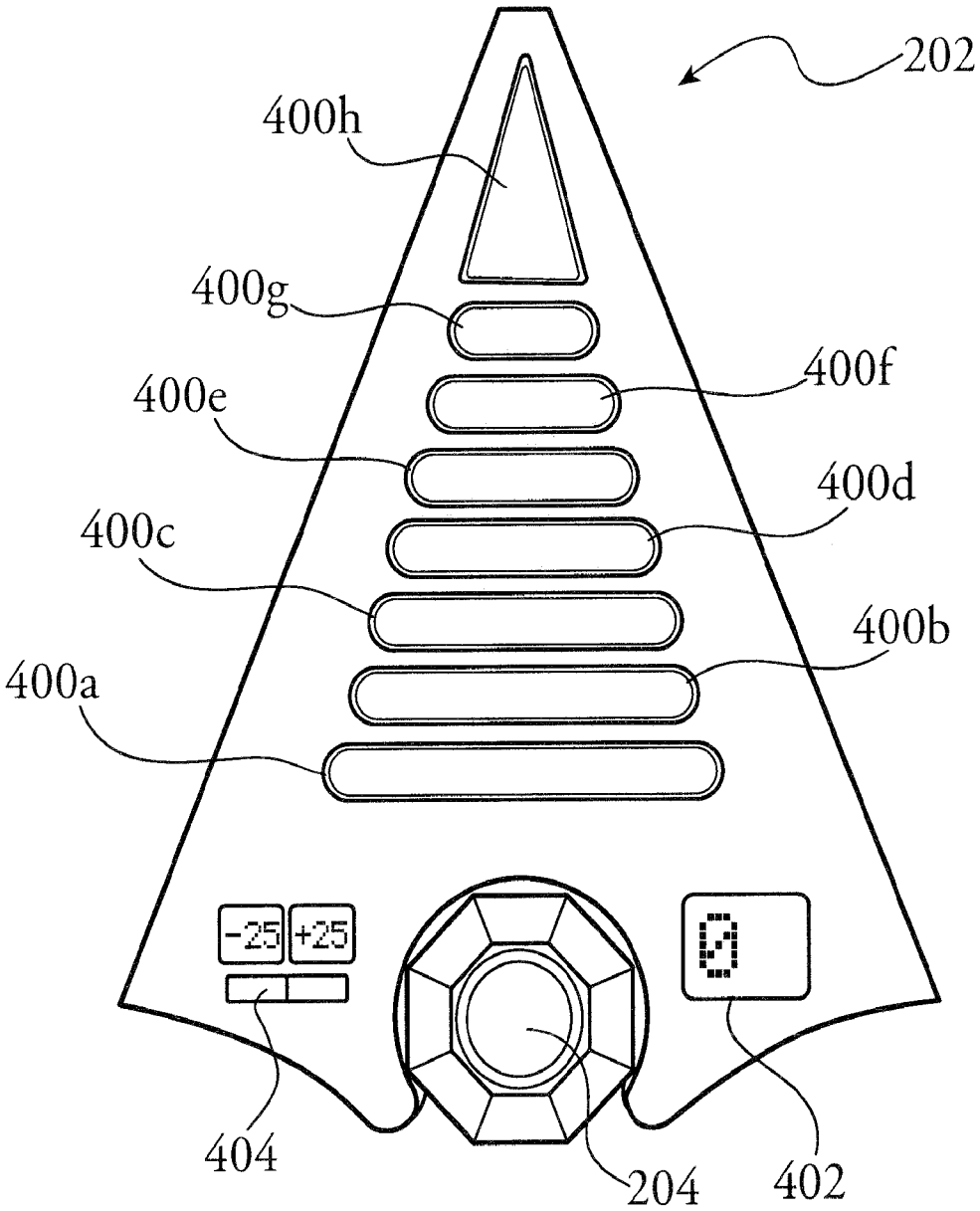
FIG. 4 is a close-up view one station of the console.

Console 200 also includes a first input 206, a second input 208, and card holder 210, each of which are optional. A more detailed view of one of the consoles 202 is provided in FIG. 4. As shown in FIG. 4, each console 202 includes an activation button 204 and a series of lights (400*a*-400*h*).

Referring again to FIG. 1, once the gaming console has been provided, step 106 is executed wherein a primary game is played. The game is selected such that a predetermined event can occur when the game is played according to its predetermined rules. By way of illustration, the primary game may be a card game played with a traditional deck of cards. The predetermined event can be, for example, assembling a predetermined hand such as four of a kind.

According to one embodiment of the game, when the predetermined event is perceived by a first player, that player presses the activation button 204. This starts the timers associated with the other activation stations as describe above. The timer associated with the first player's station is not activated. A signal is given to the other players that their timers have started. The signal may be visual (e.g. a light), auditory or both. Each player with an active timer attempts to quickly activate their activation button which stops their timer. Points are awarded to those players who react quickly, thus minimizing the amount of time measured by their timer. Points may be award based on time (e.g. 10 points less one point per second of delay) or relative order (e.g. first person to stop their timer is awarded 13 points, second person is awarded 11 points, etc.). The first player is awarded a greater number of points (e.g. 25) for being the first to activate a button despite there being no reaction-time measurement. After the round has been resolved, the lights and timers are reset prior to the next round.

In some embodiments, the signal that the timer has started is a series of lights such as lights 404*a*-404*h* of FIG. 4. In one embodiment, once the timer is activated, light 404*a* illuminates. After a predetermined time interval (e.g. 0.5 seconds) light 404*b* illuminates. The series of lights continue to sequentially illuminate in a row until lights 404*h* is illuminated. In the embodiment shown in FIG. 4, eight lights are present. Thus the maximum amount of time is four seconds for the embodiment described above. In other embodiments, the predetermined interval varies and/or the number of lights varies, thus providing a different maximum amount of time. In one embodiment, the interval of time is configured through an input such an inputs 206 and/or 208. The reaction time of all players is measured prior to beginning the next round of play.

Various primary games can be selected to customize the electronic board game to a particular purpose and/or age group. In one embodiment, the target audience is small children and the game is used as an educational tool. For example, the primary game may be a card game and the cards include images of various shapes and/or colors. The predetermined event may be drawing a particular shape (e.g. square) a particular color (e.g. blue), or a combination (e.g. holding both a square card and a blue card). More advanced games may use cards that include letters of the alphabet where the predetermined goal is to spell a certain word (e.g. "REACT"). Other advanced games may use cards that include numbers where the predetermined goal is to obtain a certain value using a mathematical function. For example, the goal may be the number twelve. The goal could be achieved, for example, by holding two sixes which sum to twelve or by holding a six and a two, the product of which is twelve. Players can enjoy the game without recognizing they are learning.

In one aspect of the game, the player may press their activation button despite not having perceived the predetermined event. In such embodiments, each players hand is hidden from the other players. This enables players to attempt to bluff their fellow players into believing that have perceived the predetermined event. In certain embodiments, each player or team is permitted to issue a finite number (e.g. three) challenges per game. In games with multiple players, multiple challenges to the same first player can ensue. In certain embodiments, a particular card or combination of cards will permit a player to be immune to challenges. In the event such a challenge is issued, the challenged player need only show the immunity card or combination of cards to void the attempted challenge. Examples of immunity card(s) include: (1) a single joker (2) a pair of aces or (3) a particular card not found in a traditional deck.

If a challenge is issued and the first player was bluffing, then the challenger gains a certain number of points (e.g. 25 points) while the first player looses a certain number of points (e.g. either the same 25 points or a different value). When multiple challenges are issued, the first player will only deduct the lost points for loosing one challenge. Each of the challengers will gain the aforementioned points.

The game may be played between individuals or teams. Sequential rounds are played until an individual or team exceeds a predetermined score, thereby winning the overall game. Alternatively, a finite number of rounds of the game are played and, after the final round, the highest score wins the overall game. Ties may be broken by determining who scored highest on the final round.

If a challenge is issued and the first player truly has perceived the predetermined event, then the challenger looses a certain number of points (e.g. 25 points). The round is then concluded, a fresh hand is dealt, and another round may begin.

Figure 5:
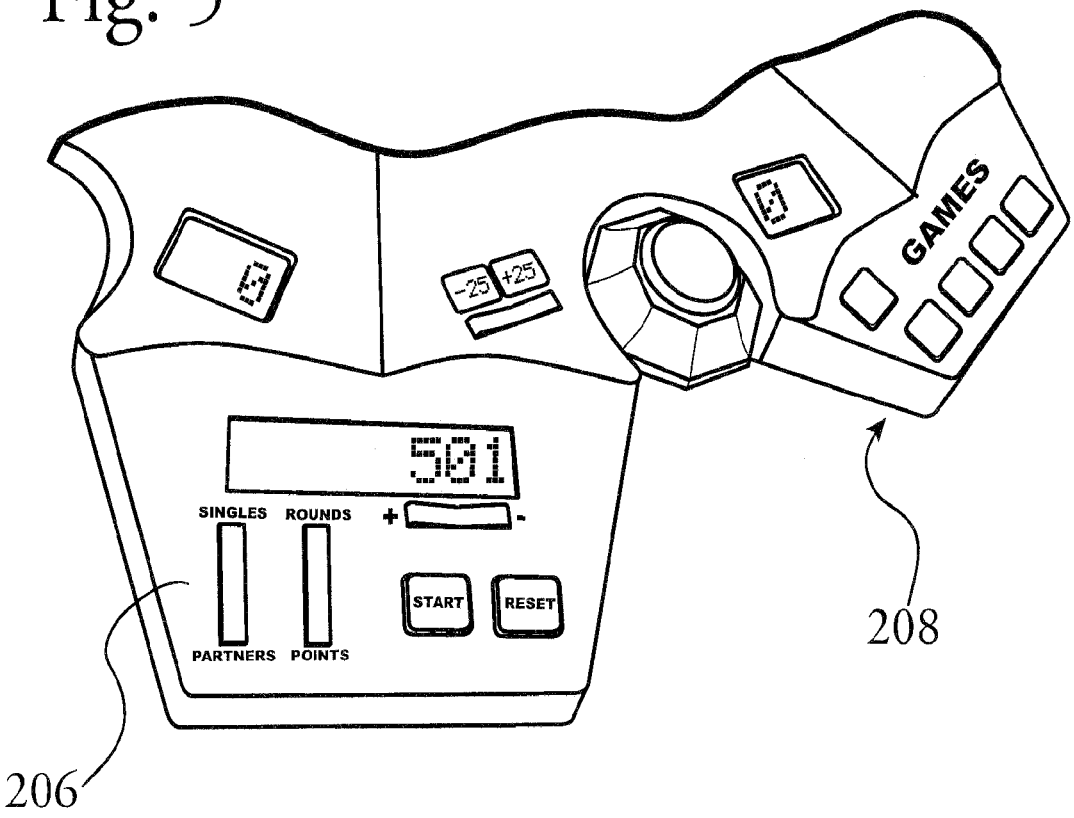
FIG. 5 is a close-up view of two inputs of the console.

Console 200 is equipped with several inputs. See FIG. 5. Input 206 includes various inputs for controlling a particular game. For example, the inputs can set the number of players who participate in a given game, which players are on the same team, the options for a particular game, the total points to be achieved before a game ends, and the like.

Figure 6:
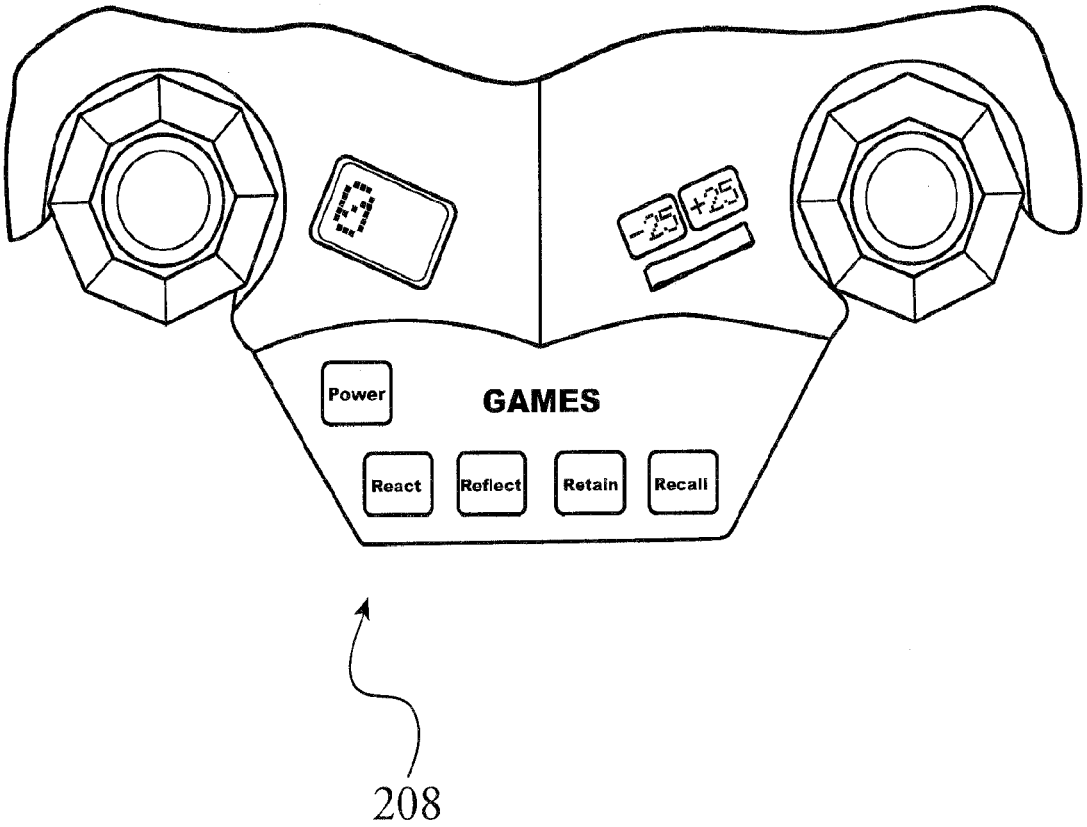
FIG. 6 is a close-up view of one of the inputs of the console.

Input 208, shown in several figures including FIG. 6, permits console to be configured to play more than one preprogrammed game. Input 208 includes a power button and a plurality of game selection buttons. In FIG. 6, four such games are shown including REACT, REFLECT, RETAIN, and RECALL.

The game of REACT has been described above. In addition to the game of REACT, the other games may be played on console 200.

In the game of REFLECT, the plurality of lights 400*a*-400*h* of each station simulate the motion of a ball that bounces between light 400*a* of a first station and light 400*a* of a second station. The game begins by illuminating light, such as 400*h*, of a random station. Lights 400*g*, 400*f*, 400*e*, 400*d*, 400*c*, 400*b* and 400*a* are sequentially activated. The controller of the first station must activate their activation button 204 within a predetermined time of the illumination of light 400*a*. Doing so places the button in a "cool down" state where it cannot be activated again for a predetermined period of time. This cool down state penalizes those players who activate the button too early. If the button is not activated within the predetermined time window, the player's points are penalized. If the button is successfully activated within the predetermined time window, the lights activate in the reverse order (400*a*, 400*b*, 400*c*, 400*d*, 400*e*, 400*f*, 400*g*, 400*h*) to simulate the return of the ball. Thereafter another station is randomly selected and that player is likewise challenged to timely activate their button. In one embodiment, the delay between the activation of the lights gets smaller as the game progresses, thus the ball appears to move faster. This makes it more difficult to timely activate the button. Points can be tracked in score screen 402. In some embodiments, points accumulate for each successful use of the button, thus higher scores are beneficial. In other embodiments, the score begins at a certain value and points are deducted when a player "misses" which makes higher scores desirable. In other embodiments, points are increased when a player misses, thus making lower scores desirable.

In the game of RETAIN, the primary game is a card game such as a version of poker. Players begin by getting a set amount of points to simulate chips, then press a "bet" button to begin a betting round. The bet button may be, for example, on interface 206. During betting round these allotted points are used to bet with using the activation buttons. The more a player presses their button, the higher value the bet and the higher their own lights go. Players bet simultaneously and their individual lights are lit on any button press. The higher the lights, the higher the bet. This is a new and dynamic approach to betting that is more interactive and socially fun. Players who do not match the current high bet fold. Players who exceed the current high et raise. Players who match the current high bet call. Players who do not bet at all check.

In the game of RECALL, one or more lights 400*a*-400*k* of a first station is activated and thereafter one or more lights of a randomly determined second station is activated. The game then causes and permits the player to activate the buttons of the first and second station, thus repeating the pattern back to the console. In the second round, the pattern of the first round is repeated, but a third randomly determined third station is added. As the number of stations involved in the pattern become larger, the complexity of the pattern is increased. This makes it more challenging to echo the pattern back to the console.

In the game of REBOUND, the rules are similar to those of REFLECT except in that several balls travel toward each player simultaneously at a rate that varies by each round. Players have a finite window of opportunity to cause the ball to rebound to the top of the series of lights by pressing their activation button. The more precisely the player times his or her button, the higher the ball travels back toward its source and the more points they score. Play continues until the first player achieves a target score.

EXAMPLE 1

Four players participate in the present example. Two standard decks of cards are shuffled together and are used in the primary game. The predetermined event is to be holding four cards with the same face value (e.g. four two's or four queens). The jokers have been removed. One of the players is designated to be the dealer and four cards are sequentially deal to each of the four players. The remaining cards are placed in card holder 210. During the primary game, each player may only keep four cards. On the first round, the dealer draws a card from card holder 210 and sees if the current hand is four of a kind. In the present example, it is not. The dealer selects one of the five cards and passes the selected card to a second player. The second player, now holding five cards, sees if their current hand includes four of a kind. In the present example, it does not. The second player passes a selected card to the third player who checks his or her hand. The third player passes a selected card to the fourth player who also checks his or her hand. If no player has four of a kind, the fourth player discards a selected card into a discard pile. The first player then draws another card from card hold 210 and the round repeats.

In the present example, a card is passed to the third player and the third player thereafter activates their activation button. A signal, which includes both lights and sounds, is given and the other players race to activate their activation buttons. The fourth player reactions the fastest, with the second player following thereafter. The first player is the last to activate the button. 25 points is awarded to the third player. The fourth player receives 13 points. The second player receives 11 points and the fourth player receives 9 points. The particular point values awarded may vary depending on the number of players. These values are determined by the game console 200 and are displayed on the corresponding score screen 402 of each console. See FIG. 4.

According to the rules of the present example, each of the first, second and fourth players may issue up to three challenges per game. Each of these players must now evaluate the likelihood that the third player is bluffing. Depending on the outcome of the challenge, the score of each player can be adjusted using challenge buttons 404 of FIG. 4. In the present example, no challenge is issued and each of the players saves their three challenges for a later round.

EXAMPLE 2

Example 2 is substantially identical to Example 1 except that the first player decides to use one of that player's three challenges to challenge the third player. The third player reveals her hand and shows that she truly does have four of a kind. The first player therefore looses the challenge. The first players point total is reduced by 25 points using challenge button 404.

EXAMPLE 3

Example 3 is substantially identical to Example 1, except in that the deck includes several jokers which act as immunity cards. The first player decides to use one of that player's three challenges to challenge the third player. In response, the third player reveals a joker card. The challenge stops with no points being adjusted for any party. This does not consume one the first player's three permitted challenges. Since player three currently has five cards (prior to passing) it is unclear whether or not the third player truly has four of a kind. The round is scored as described in Example 1.

EXAMPLE 4

One player participates in the present example. Often, children enjoy the sounds and lights that result from pressing the activation button. In this embodiment of the game, a single station is provided which illuminates the lights described above when the activation button is pressed. The primary game can be a card game, such as flash cards. When the child correctly answers the question on the flash card, the child is permitted to press the button and is rewarded with the sounds and lights.

EXAMPLE 5

Two players participate in the present example. The console includes two active stations. The primary game is a game of question and answer. The first player to press their activation button has the first opportunity to answer. If they answer incorrectly, the second player has an opportunity to answer.

EXAMPLE 6

Three players participate in the present example. The console includes three active stations. The primary game is a game of question and answer. The first player to press their activation button has the first opportunity to answer. Once the button of the first player is activated, the remaining players attempt to quickly activate their buttons. The players are ordered by reaction time with the fastest reaction times being offered a chance to answer the question before the slower players, in the event the first player fails to correctly answer the question.

EXAMPLE 7

Example 7 is substantially identical to Example 1, except in that the deck is a customized deck of cards that include one letter of the alphabet per card. Players are initially dealt ten cards and the predetermined event is to be able to spell the word "REACT."

EXAMPLE 8

Example 8 is substantially identical to Example 7, except in that the customized deck includes an immunity card.

While the invention has been described with reference to preferred embodiments, it will be understood by those skilled in the art that various changes may be made and equivalents may be substituted for elements thereof to adapt to particular situations without departing from the scope of the invention.

Therefore, it is intended that the invention not be limited to the particular embodiments disclosed as the best mode contemplated for carrying out this invention, but that the invention will include all embodiments falling within the scope and spirit of the appended claims.

What is claimed is:

1. A process for playing an electronic board game comprising:

providing an electronic gaming console that includes one station for each player, including at least a first, a second and a third station, each of which includes an activation button and a timer, the timer of the first station configured to measure the time between the pressing of the activation button of the second or third station and the pressing of the activation button of the first station;

the timer of the second station configured to measure the time between the pressing of the activation button of the first or third station and the pressing of the activation button of the second station;

the timer of the third station configured to measure the time between the pressing of the activation button of the first or second station and the pressing of the activation button of the third station;

playing a primary game between at least a first player, a second player and a third player, associated with the first, second and third station, respectively, wherein a predetermined event occurs during the primary game;

pressing the activation button of the first station by the first player, thereby alleging the first player has perceived the predetermined event;

signaling, to the second player and third player, the start of the timer of the second and third stations;

pressing the activation button of the second station by the second player, in response to the pressing of the activation button of the first station by the first player, thereby measuring the time between the pressing of the activation button of the first station and the pressing of the activation button of the second station;

pressing the activation button of the third station by the third player, in response to the pressing of the activation button of the first station by the first player, thereby measuring the time between the pressing of the activation button of the first station and the pressing of the activation button of the third station;

awarding points to the second player based on the time between the pressing of the activation button of the first station and the pressing of the activation button of the second station;

awarding points to the third player based on the time between the pressing of the activation button of the first station and the pressing of the activation button of the third station.

2. The process as recited in claim 1, wherein the primary game is a card game.

3. The process as recited in claim 2, wherein the predetermined event is having a predetermined hand.

4. The process as recited in claim 3, wherein the predetermined hand is a four of a kind.

5. The process as recited in claim 2, wherein the cards include pictures and predetermined event is having a predetermined number of a particular picture.

6. The process as recited in claim 5, wherein the pictures on the cards denote colors.

7. The process as recited in claim 5, wherein the pictures on the cards denote shapes.

8. The process as recited in claim 5, wherein the pictures on the cards denote letters of the alphabet.

9. The process as recited in claim 5, wherein the pictures on the cards denote numbers.

10. The process as recited in claim 1, wherein the primary game does not eliminate players.

11. A process for playing an electronic board game comprising:

providing an electronic gaming console that includes one station for each player, including at least a first, a second and a third station, each of which includes an activation button and a timer, the timer of the first station configured to measure the time between the pressing of the activation button of the second or third station and the pressing of the activation button of the first station;

the timer of the second station configured to measure the time between the pressing of the activation button of the first or third station and the pressing of the activation button of the second station;

the timer of the third station configured to measure the time between the pressing of the activation button of the first or second station and the pressing of the activation button of the third station;

providing the second player with a finite number of challenges per game;

playing a primary game between at least a first player, a second player and a third player, associated with the first, second and third station, respectively, wherein a predetermined event occurs during the primary game;

pressing the activation button of the first station by the first player, thereby alleging the first player has perceived the predetermined event;

signaling, to the second player and third player, the start of the timer of the second and third stations;

pressing the activation button of the second station by the second player, in response to the pressing of the activation button of the first station by the first player, thereby measuring the time between the pressing of the activation button of the first station and the pressing of the activation button of the second station;

pressing the activation button of the third station by the third player, in response to the pressing of the activation button of the first station by the first player, thereby measuring the time between the pressing of the activation button of the first station and the pressing of the activation button of the third station;

permitting the second or third player to use one of the challenges, thereby asking the first player to reveal whether or not the first player has accurately perceived the predetermined event;

awarding points to all of the players based on the time between the pressing of the activation button of the first station and the pressing of the activation button of each player's station.

12. The process as recited in claim 11, wherein the first player reveals an immunity card, thereby blocking the second player's attempt to reveal whether or not the first player has accurately perceived the predetermined event.

* * * * *